US011548758B2

(12) United States Patent
Roberts et al.

(10) Patent No.: US 11,548,758 B2
(45) Date of Patent: Jan. 10, 2023

(54) HEALTH MONITORING SYSTEMS AND METHODS FOR ELEVATOR SYSTEMS

(71) Applicant: Otis Elevator Company, Farmington, CT (US)

(72) Inventors: Randy Roberts, Hebron, CT (US); Edward Piedra, Chicopee, MA (US); Bruce P. Swaybill, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1156 days.

(21) Appl. No.: 16/000,004

(22) Filed: Jun. 5, 2018

(65) Prior Publication Data

US 2019/0002235 A1 Jan. 3, 2019

Related U.S. Application Data

(60) Provisional application No. 62/527,249, filed on Jun. 30, 2017.

(51) Int. Cl.
*B66B 1/40* (2006.01)
*B66B 1/30* (2006.01)
(Continued)

(52) U.S. Cl.
CPC ..... *B66B 1/30* (2013.01); *B66B 5/0018* (2013.01); *B66B 2201/00* (2013.01)

(58) Field of Classification Search
CPC ..... B66B 1/30; B66B 1/3492; B66B 5/12; B66B 7/10
See application file for complete search history.

(56) References Cited

U.S. PATENT DOCUMENTS 4,319,665 A 3/1982 Komuro et al.
4,887,695 A 12/1989 Kindler
(Continued)

FOREIGN PATENT DOCUMENTS

CN 104176577 12/2014
CN 102762480 2/2015
(Continued)

OTHER PUBLICATIONS

European Search Report for EP Application No. 18180901.3, International Filing Date Jun. 29, 2018, dated Nov. 26, 2018, 11 pages.

*Primary Examiner* — Christopher Uhlir
(74) *Attorney, Agent, or Firm* — Cantor Colburn LLP

(57) ABSTRACT

Methods and systems for monitoring a dynamic compensation control system of an elevator system are provided. The methods and systems include monitoring a first motion state sensor signal generated by a first motion state sensor, the first motion state sensor associated with an elevator machine, monitoring a second motion state sensor signal generated by a second motion state sensor, the second motion state sensor located on an elevator car, determining an operational status of the second motion state sensor based on an analysis of the first motion state sensor signal and the second motion state sensor signal, and when it is determined that a failure status of the second motion state sensor is present, the method further comprises deactivating a dynamic compensation control mode of operation of the elevator system.

14 Claims, 9 Drawing Sheets

(51) Int. Cl.
*B66B 1/34* (2006.01)
*B66B 5/00* (2006.01)

(56) References Cited

U.S. PATENT DOCUMENTS

| | | | | |
|---|---|---|---|---|
| 5,035,301 | A | 7/1991 | Skalski | |
| 5,274,203 | A | 12/1993 | Skalski et al. | |
| 5,304,751 | A | 4/1994 | Skalski et al. | |
| 5,747,755 | A | 5/1998 | Coste et al. | |
| 6,089,355 | A * | 7/2000 | Seki | B66B 1/30 187/292 |
| 7,007,774 | B2 * | 3/2006 | Utsunomiya | B66B 7/042 187/292 |
| 7,588,127 | B2 | 9/2009 | Shiratsuki et al. | |
| 7,614,482 | B2 * | 11/2009 | Shikai | B66B 5/02 73/158 |
| 7,617,911 | B2 * | 11/2009 | Matti | B66B 5/048 187/361 |
| 7,621,377 | B2 * | 11/2009 | Husmann | B66B 11/0266 187/292 |
| 7,950,499 | B2 | 5/2011 | Okamoto et al. | |
| 8,006,808 | B2 | 8/2011 | Piedra et al. | |
| 8,261,886 | B2 * | 9/2012 | Kigawa | B66B 5/00 187/393 |
| 8,746,411 | B2 * | 6/2014 | Roberts | B66B 17/34 187/291 |
| 2013/0118836 | A1 | 5/2013 | Rossignol | |
| 2016/0023864 | A1 * | 1/2016 | Roberts | B66B 1/44 187/254 |
| 2016/0214832 | A1 | 7/2016 | Banno et al. | |
| 2016/0221794 | A1 * | 8/2016 | Stolt | B66B 5/14 |
| 2017/0057782 | A1 | 3/2017 | Roberts et al. | |

FOREIGN PATENT DOCUMENTS

| | | | |
|---|---|---|---|
| CN | 204897072 | | 12/2015 |
| EP | 1278693 | | 1/2003 |
| EP | 2048103 | A1 | 4/2009 |
| EP | 1602610 | B1 | 4/2010 |
| EP | 2527281 | | 11/2012 |
| JP | H08301539 | A | 11/1996 |
| JP | 2002241062 | | 8/2002 |
| JP | 2005051865 | A | 2/2005 |
| JP | 3958551 | | 8/2007 |
| JP | 2009012932 | A | 1/2009 |
| JP | 2010275078 | | 12/2010 |

* cited by examiner

HEALTH MONITORING SYSTEMS AND METHODS FOR ELEVATOR SYSTEMS

CROSS-REFERENCE TO RELATED APPLICATIONS

The present application claims priority from U.S. Provisional Patent Application No. 62/527,249, filed Jun. 30, 2017. The content of the priority application is hereby incorporated by reference in its entirety.

BACKGROUND

The subject matter disclosed herein generally relates to elevator systems and, more particularly, to health monitoring systems and methods of features of elevator systems.

An elevator system typically includes a plurality of belts or ropes (load bearing members) that move an elevator car vertically within a hoistway or elevator shaft between a plurality of elevator landings. When the elevator car is stopped at a respective one of the elevator landings, changes in magnitude of a load within the car can cause changes in vertical motion state (e.g., position, velocity, acceleration) of the car relative to the landing. The elevator car can move vertically down relative to the elevator landing, for example, when one or more passengers and/or cargo move from the landing into the elevator car. In another example, the elevator car can move vertically up relative to the elevator landing when one or more passengers and/or cargo move from the elevator car onto the landing. Such changes in the vertical position of the elevator car can be caused by soft hitch springs and/or stretching and/or contracting of the load bearing members, particularly where the elevator system has a relatively large travel height and/or a relatively small number of load bearing members. Under certain conditions, the stretching and/or contracting of the load bearing members and/or hitch springs can create disruptive oscillations in the vertical position of the elevator car, e.g., an up and down "bounce" motion.

SUMMARY

According to some embodiments, methods of monitoring dynamic compensation control systems of elevator systems are provided. The methods include monitoring a first motion state sensor signal generated by a first motion state sensor, the first motion state sensor associated with an elevator machine, monitoring a second motion state sensor signal generated by a second motion state sensor, the second motion state sensor located on an elevator car, determining an operational status of the second motion state sensor based on an analysis of the first motion state sensor signal and the second motion state sensor signal, and when it is determined that a failure status of the second motion state sensor is present, the method further comprises deactivating a dynamic compensation control mode of operation of the elevator system.

In addition to one or more of the features described herein, or as an alternative, further embodiments of the methods may include performing a dynamic compensation control mode of operation to control a motion state of the elevator car relative to a landing with a computing system and the elevator machine, wherein the dynamic compensation control includes receiving the first motion state sensor signal at a computing system, receiving the second motion state sensor signal at the computing system, and controlling the elevator machine to minimize oscillations, vibrations, excessive position deflections, and/or bounce of the elevator car at the landing.

In addition to one or more of the features described herein, or as an alternative, further embodiments of the methods may include that the determination of the operational status of the second motion state sensor is performed during a travel of the elevator car between landings of the elevator system.

In addition to one or more of the features described herein, or as an alternative, further embodiments of the methods may include performing a re-leveling operation with the elevator machine and the first motion state sensor signal at a landing when the dynamic compensation control mode of operation is deactivated.

In addition to one or more of the features described herein, or as an alternative, further embodiments of the methods may include that the failure status is based on a determination that the second motion state sensor signal is outside of a predetermined tolerance.

In addition to one or more of the features described herein, or as an alternative, further embodiments of the methods may include that the predetermined tolerance is defined by an upper boundary and a lower boundary relative to the first motion state sensor signal.

In addition to one or more of the features described herein, or as an alternative, further embodiments of the methods may include that the predetermined tolerance is one of (i) fixed for all distances of travel of the elevator car with an elevator shaft or (ii) variable based on a distance of travel of the elevator car within an elevator shaft.

In addition to one or more of the features described herein, or as an alternative, further embodiments of the methods may include that the first motion state sensor and the second motion state sensor each measure one of a position, a velocity, an acceleration, or a combination thereof.

In addition to one or more of the features described herein, or as an alternative, further embodiments of the methods may include generating a notification regarding a failure status and transmitting said notification to provide notice that maintenance is required on the second motion state sensor.

According to some embodiments, elevator control systems are provided. The elevator control systems include an elevator machine operably connected to an elevator car located within an elevator shaft, a first motion state sensor arranged relative to the elevator machine to monitor a motion state of the elevator car within the elevator shaft, a second motion state sensor arranged on the elevator car and configured to monitor a motion state of the elevator car with the elevator shaft, and a computing system in communication with the first motion state sensor and the second motion state sensor, the computing system receiving a respective first motion state sensor signal and a second motion state sensor signal, the computing system configured to perform health monitoring of the second motion state sensor. The health monitoring includes monitoring the first and second motion state sensor signals, determining an operational status of the second motion state sensor based on an analysis of the first motion state sensor signal and the second motion state sensor signal, and, when it is determined that a failure status of the second motion state sensor is present, the computing system deactivates a dynamic compensation control mode of operation of the elevator system.

In addition to one or more of the features described herein, or as an alternative, further embodiments of the elevator control systems may include that the computing system is configured to perform a dynamic compensation control mode of operation to control a motion state of the elevator car relative to a landing by controlling the elevator machine. The dynamic compensation control includes receiving the first and second motion state sensor signals at the computing system and controlling the elevator machine to minimize oscillations, vibrations, excessive position deflections, and/or bounce of the elevator car at the landing.

In addition to one or more of the features described herein, or as an alternative, further embodiments of the elevator control systems may include that the determination of the operational status of the second motion state sensor is performed during a travel of the elevator car between landings of the elevator system.

In addition to one or more of the features described herein, or as an alternative, further embodiments of the elevator control systems may include that the computing system is configured to perform a re-leveling operation with the elevator machine and the first motion state sensor signal at a landing when the dynamic compensation control mode of operation is deactivated.

In addition to one or more of the features described herein, or as an alternative, further embodiments of the elevator control systems may include that the failure status is based on a determination that the second motion state sensor signal is outside of a predetermined tolerance.

In addition to one or more of the features described herein, or as an alternative, further embodiments of the elevator control systems may include that the predetermined tolerance is defined by an upper boundary and a lower boundary relative to the first motion state sensor signal.

In addition to one or more of the features described herein, or as an alternative, further embodiments of the elevator control systems may include that the predetermined tolerance is one of (i) fixed for all distances of travel of the elevator car with an elevator shaft or (ii) variable based on a distance of travel of the elevator car within an elevator shaft.

In addition to one or more of the features described herein, or as an alternative, further embodiments of the elevator control systems may include that the motion states monitored by the first and second motion states sensors are one of a position, a velocity, an acceleration, or a combination thereof.

In addition to one or more of the features described herein, or as an alternative, further embodiments of the elevator control systems may include that the computing system is configured to generate a notification regarding a failure status and transmitting said notification to provide notice that maintenance is required on the second motion state sensor.

In addition to one or more of the features described herein, or as an alternative, further embodiments of the elevator control systems may include that at least one of the first motion state sensor and the second motion state sensor is an encoder.

In addition to one or more of the features described herein, or as an alternative, further embodiments of the elevator control systems may include a roller guide located on an exterior of the elevator car and arranged to guide movement of the elevator car relative to a guide rail, wherein the second motion state sensor is an encoder arranged to monitor the roller guide.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
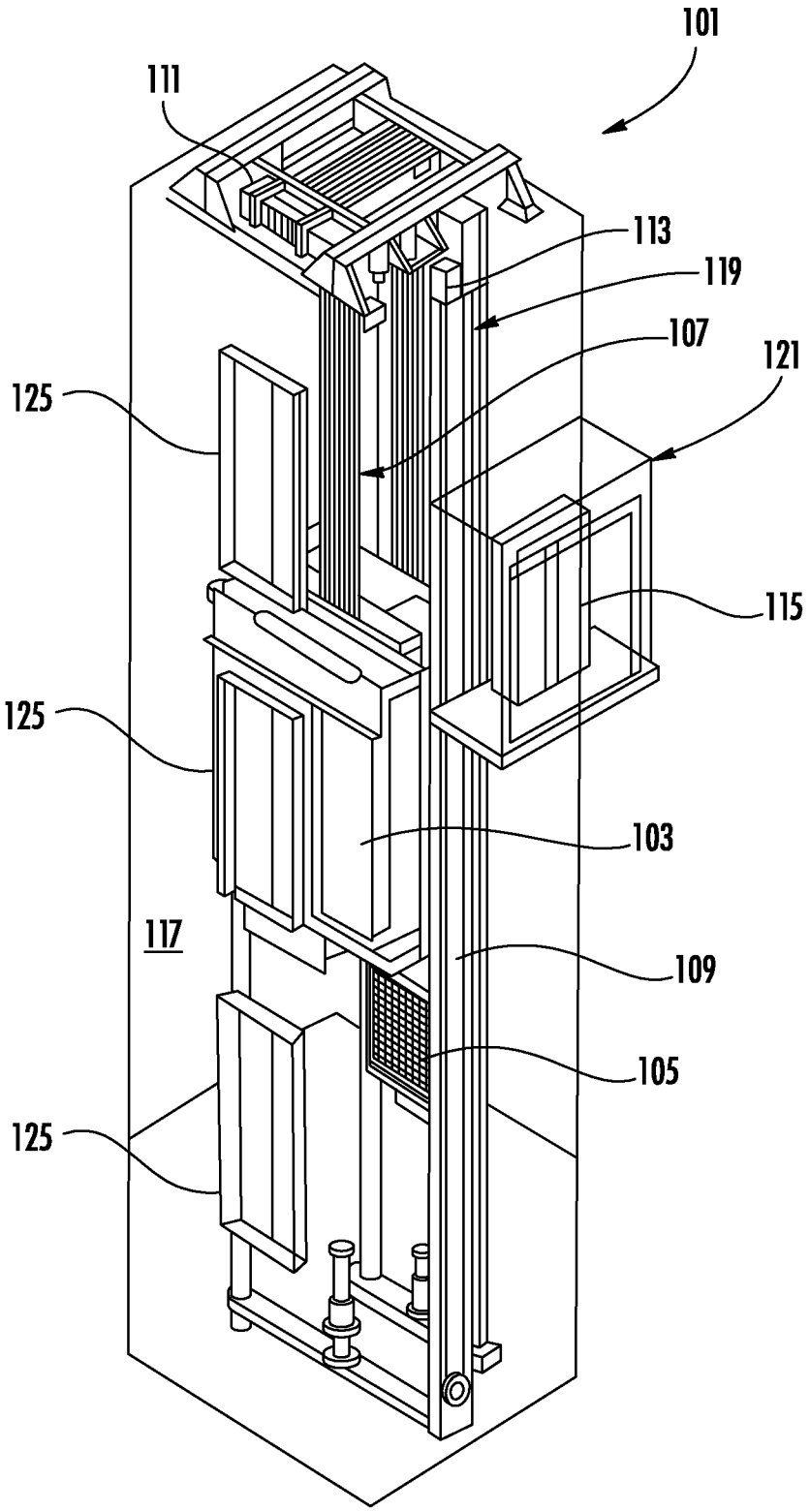
FIG. 1A is a schematic illustration of an elevator system that may employ various embodiments of the disclosure.

FIG. 1A is a perspective view of an elevator system 101 including an elevator car 103, a counterweight 105, a roping 107, a guide rail 109, a machine 111, a machine motion state sensor 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The machine motion state sensor 113 may be mounted on an upper sheave of a speed-governor system 119 and may be configured to provide motion state signals related to a motion state of the elevator car 103 within the elevator shaft 117. As used herein the term "motion state" includes various properties of motion including, but not limited to, position, velocity, acceleration, and combinations thereof. In some embodiments, the machine motion state sensor 113 may be directly mounted to a moving component of the machine 111, or may be located in other positions and/or configurations as known in the art. In some embodiments, the machine motion state sensor 113 may be an encoder connected to the machine 111.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive motion state signals from the machine motion state sensor 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1A is merely a non-limiting example presented for illustrative and explanatory purposes.

Figure 1B:
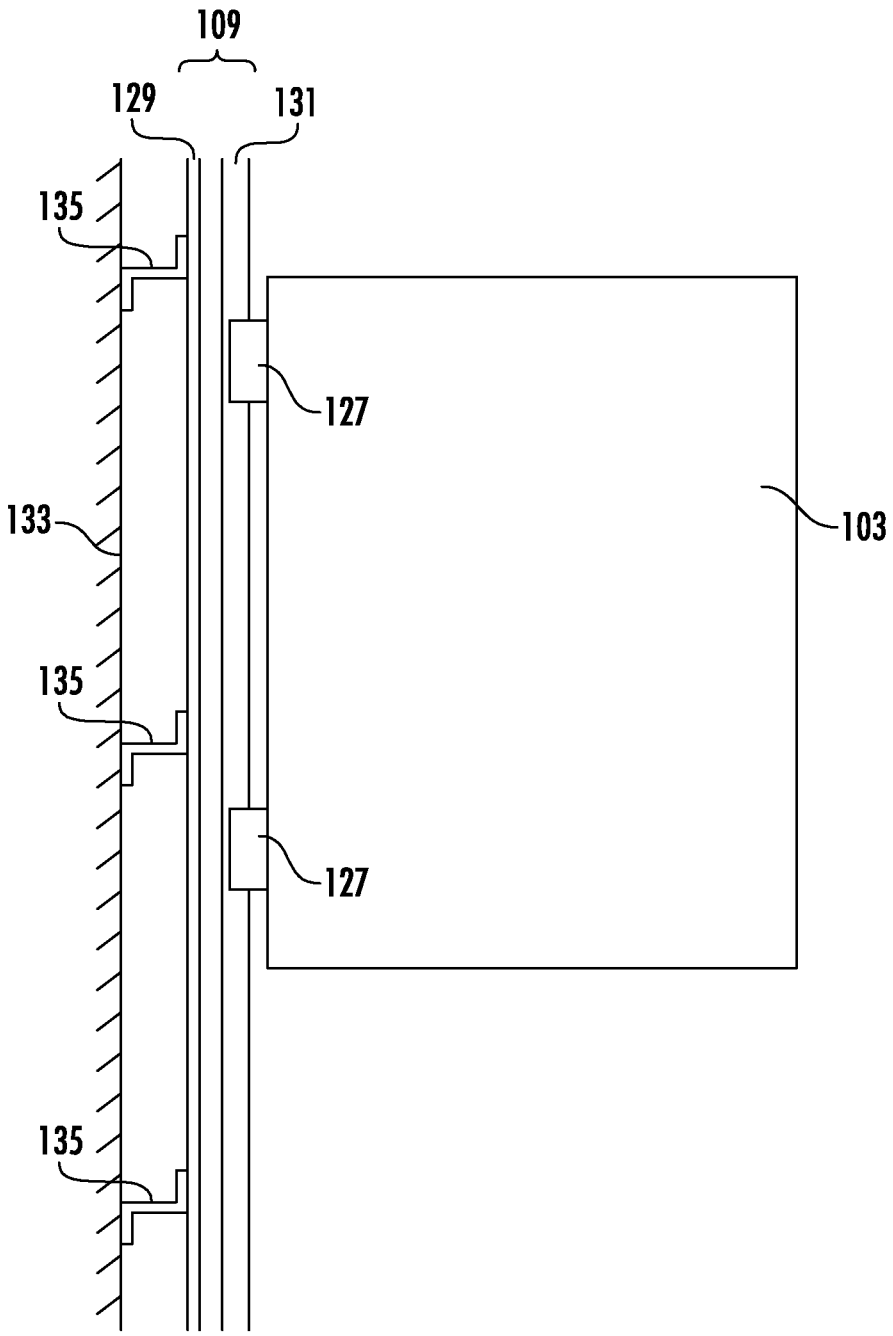
FIG. 1B is a side schematic illustration of an elevator car of FIG. 1A attached to a guide rail track.

FIG. 1B is a side view schematic illustration of the elevator car 103 as operably connected to the guide rail 109. As shown, the elevator car 103 connects to the guide rail 109 by one or more guiding devices 127. The guiding devices 127 may be guide shoes, rollers, etc., as will be appreciated by those of skill in the art. The guide rail 109 defines a guide rail track that has a base 129 and a blade 131 extending therefrom. The guiding devices 127 of the elevator car 103 are configured to run along and/or engage with the blade 131 of the guide rail 109. The guide rail 109 mounts to a wall 133 of the elevator shaft 117 (shown in FIG. 1A) by one or more brackets 135. The brackets 135 are configured to fixedly mount to the wall 133, such as by bolts, fasteners, etc. as known in the art. The base 129 of the guide rail 109 fixedly attaches to the brackets 135, and thus the guide rail 109 can be fixedly and securely mounted to the wall 133. As will be appreciated by those of skill in the art, a guide rail of a counterweight of an elevator system may be similarly configured.

Embodiments provided herein are directed to apparatuses, systems, and methods related to elevator control and, particularly, to management systems for vibration compensation systems that rapidly adjust and account for bounce, oscillations, and/or vibrations of elevator cars. As used herein, an "elevator dynamic compensation control mode" is a mode of operation that is used by elevator systems at landings when an elevator car moves up or down (e.g., bounce) due to load changes and/or extension/contraction of load bearing members to provide a continuous re-levelling feature (e.g., level user experience for passengers). According to embodiments provided herein, systems and methods of monitoring such elevator dynamic compensation control systems are provided.

An elevator dynamic compensation control system in accordance with embodiments of the present disclosure has two motion state sensors. For example, a first motion state sensor of the elevator dynamic compensation control system may be the machine motion state sensor (e.g., machine motion state sensor 113 shown in FIG. 1A) that is used for motion control of the elevator car. A second motion state sensor may be installed on the elevator car itself (e.g., an "on-car motion state sensor"), as described herein, that is used to control elevator car sag and bounce. The second motion state sensor, in some embodiments, may be an on-car encoder. A health management system, in accordance with embodiments of the present disclosure, is in communication with the first and second motion state sensors and receives motion state sensor signals from the motion state sensors to estimate a performance of the on-car motion state sensor to ensure proper installation and adjustment and to minimize a likelihood of failure during operation. A comparison of the motion state sensor signals can be constantly performed in a diagnostic and prognostic manner to detect and predict failure or other health status of the elevator dynamic compensation control system and on-car motion state sensor.

A motion state detection element and/or functionality is provided on-car, and can be integrated into roller guides of the elevator car (e.g., guiding devices 127 shown in FIG. 1B). That is, in accordance with embodiments of the present disclosure, a motion state sensing element (e.g., an on-car motion state sensor) is incorporated into the guiding device such that an accurate motion state of the elevator car within the elevator shaft can be determined. As used herein, the term "motion state" includes, but is not limited to, position, velocity, and acceleration of an elevator car. The motion state information can then be used to minimize vibration, oscillation, and bounce of the elevator car. The motion state information can be provided to a health monitoring system to ensure proper operation of the on-car motion state sensor.

Figure 2A:
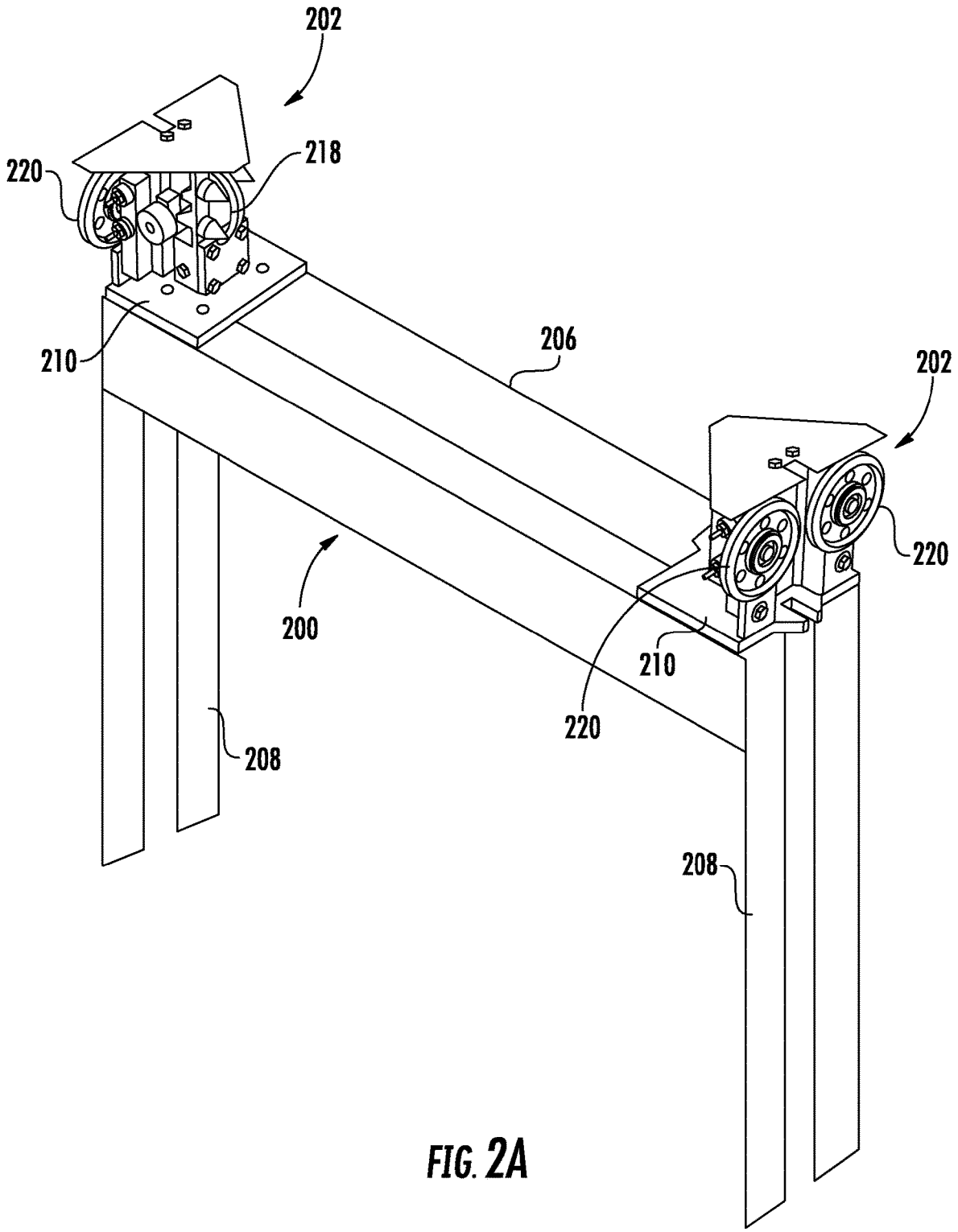
FIG. 2A is a partial isometric illustration of an elevator car frame having roller guides in accordance with an embodiment of the present disclosure mounted thereto.
Figure 2B:
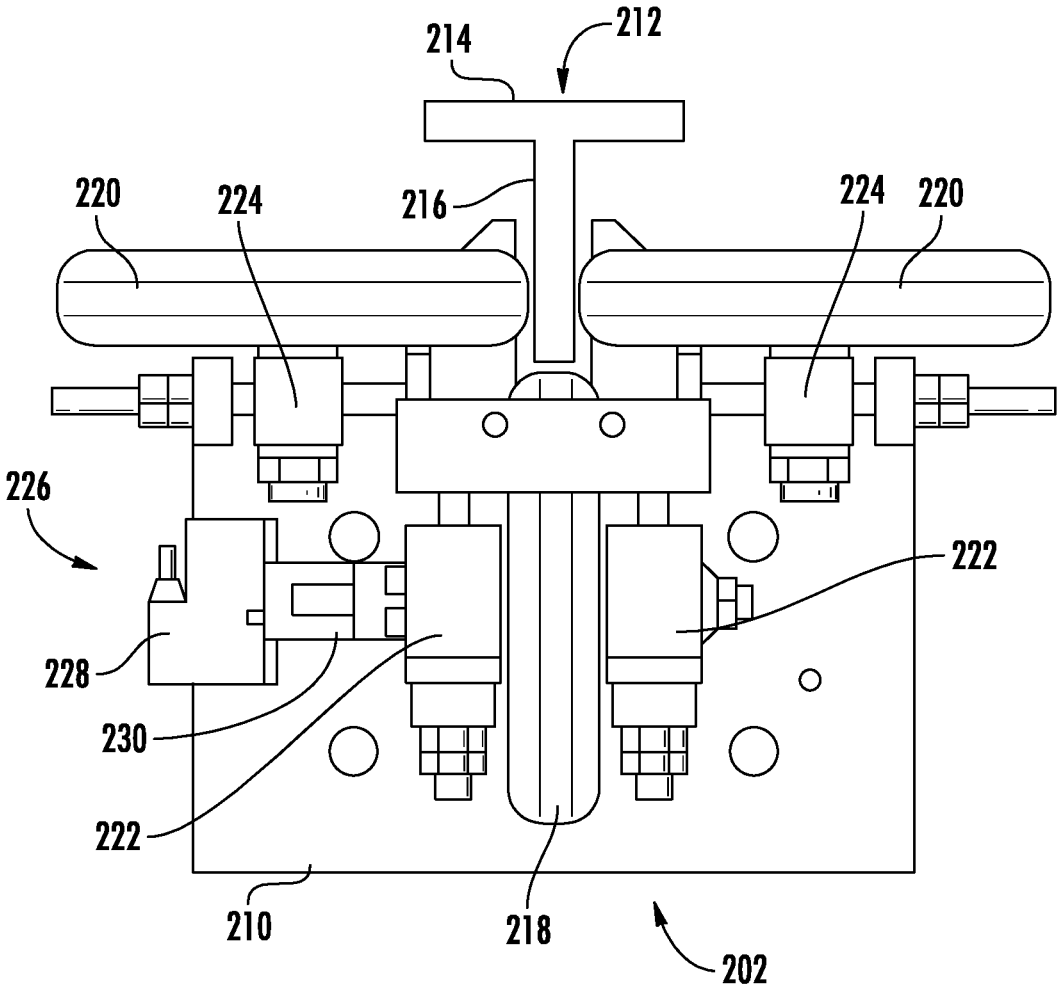
FIG. 2B is a plan view schematic illustration of one of the roller guides of FIG. 2A.

Turning now to FIGS. 2A-2B, schematic illustrations of elevator car guiding devices in accordance with a non-limiting embodiment of the present disclosure are shown. FIG. 2A is a partial isometric illustration of an elevator car frame 200 having two elevator car guiding devices 202 installed thereon. FIG. 2B is a top-down schematic illustration of an elevator car guiding device 202 as engaged within a guide rail 204 of an elevator system. The elevator car frame 200 includes a crosshead frame 206 extending between vertical stiles 208. The elevator car guiding devices 202 are mounted to at least one of the crosshead from 206 and the vertical stiles 208, as known in the art, at a mounting base 210. The mounting base 210 defines at least part of a roller guide frame that is used to mount and support rolling components to an elevator car.

The elevator car guiding devices 202 are each configured to engage with and move along a guide rail 212 (shown in FIG. 2B). The guide rail 212 has a base 214 and a blade 216 and the elevator car guiding devices 202 engage with and move along the blade 216 of the guide rail 212. For example, the elevator car guiding device 202 shown in FIG. 2B includes a first roller 218 and two second rollers 220. In the present configuration and arrangement, as appreciated by those of skill in the art, the first roller 218 is a side-to-side roller and the second rollers 220 are front-to-back rollers. Although a specific configuration and arrangement is shown in FIGS. 2A-2B, those of skill in the art will appreciate that embodiments provided herein are applicable to various other elevator car guiding device configurations/arrangements. Each of the first and second rollers 218, 220 include roller wheels as known in the art.

The rollers 218, 220 are movably or rotatably mounted to the mounting base 210 by a first support bracket 222 and second support brackets 224, respectively. As will be appreciated by those of skill in the art, roller guides typically utilize wheels with rolling element bearings mounted on stationary pins (spindles) fixed to pivoting arms supported by the roller guides base, which in turn interfaces with the car frame, as described above. The pivoting arm is retained by a stationary pivot pin fixed to the base. A spring is configured to provide a restoring force and a displacement stop (e.g., a bumper). The roller wheels contact the guide rails of the elevator system and spin with the vertical motion of the car.

As provided herein, and as shown in FIGS. 2A-2B, embodiments of the present disclosure replaces one pivoting arm with an arm that supports a spinning shaft fixed to the roller wheel. The spinning shaft extends thru the arm to allow interface with an on-car motion state sensor secured to the pivoting arm with a radially compliant mount. Accordingly, to enable motion state sensing in accordance with embodiments of the present disclosure, in the embodiment shown in FIGS. 2A-2B, the first support bracket 222 also supports a motion state sensing assembly 226. The motion state sensing assembly 226, as illustrated, includes an on-car motion state sensor 228 and a connecting element 230, as described herein. Although shown and described herein with the motion state sensing assembly 226 supported on or by the first support bracket 222, those of skill in the art will appreciate that a separate and/or dedicated support or other structure can be used to mount the motion state sensing assembly to the mounting base 210 or otherwise enable the motion state sensing assembly 226 to operably interact with at least one of the rollers 218, 220.

The motion state sensing assembly 226 is configured to determine a motion state of an elevator car within an elevator shaft. The motion state sensing assembly 226, in some embodiments such as that shown in FIGS. 2A-2B, includes an on-car motion state sensor 228, such as an on-car motion state sensor. The on-car motion state sensor 228, in some configurations, can be a rotary motion state sensor or shaft motion state sensor that is an electro-mechanical device that converts the angular position or motion of a shaft or axle (e.g., connecting element 230) to an analog or digital code or signal. The signal produced by the on-car motion state sensor 228 can be transmitted to an elevator machine and/or controller to determine a specific position of the on-car motion state sensor 228 within the elevator shaft, and thus a motion state of the elevator car to which the on-car motion state sensor 228 is attached can be obtained. Accordingly, the motion state sensing assembly 226 can include various electrical components, such as memory, processor(s), and communication components (e.g., wired and/or wireless communication controllers) to determine a motion state and transmit such information to a controller or elevator machine such that the controller or elevator machine can determine an accurate motion state of the elevator car. With such information, the controller or elevator machine can perform improved control, such as, for example, during dynamic compensation control modes of operation and/or to prevent vibrations, oscillations, and/or bounce of the elevator car.

Figure 3:
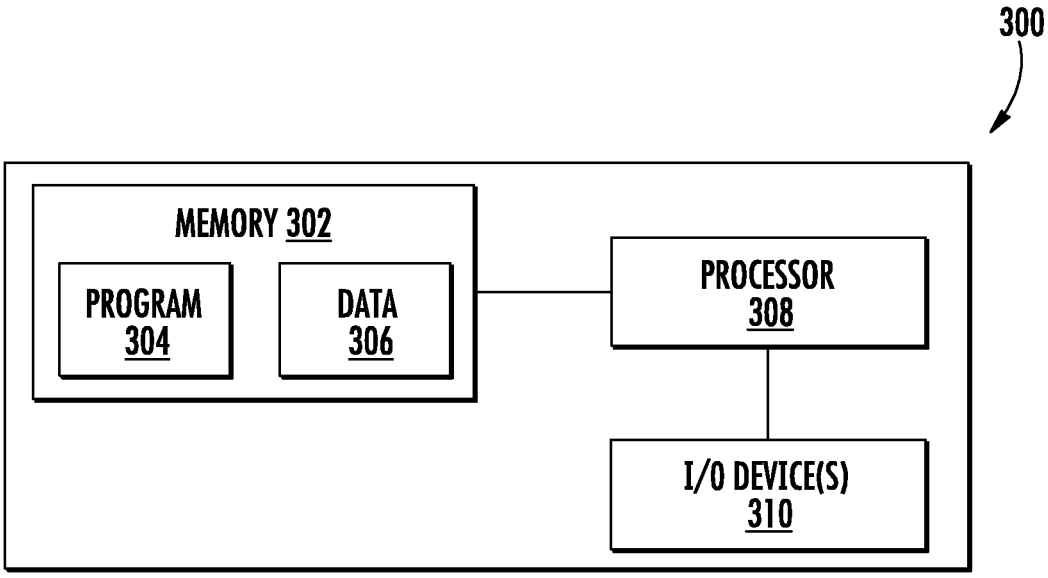
FIG. 3 is a schematic block diagram illustrating a computing system that may be configured for one or more embodiments of the present disclosure.

Referring now to FIG. 3, an example computing system 300 that can be incorporated into elevator and/or health monitoring systems of the present disclosure is shown. In various embodiments, the computing system 300 may be configured as part of and/or in communication with an elevator controller, e.g., controller 115 shown in FIG. 1, as part of a dynamic compensation control mode system, or a discrete elevator health monitoring system. The computing system 300 includes a memory 302 which can store executable instructions and/or data associated with health monitoring processes. The executable instructions can be stored or organized in any manner and at any level of abstraction, such as in connection with one or more applications, processes, routines, procedures, methods, etc. As an example, at least a portion of the instructions stored on memory 302 are associated with a health monitoring program 304.

Further, the memory 302 may store data 306. The data 306 may include, but is not limited to, elevator car data, elevator modes of operation, commands, or any other type(s) of data as will be appreciated by those of skill in the art. The instructions stored in the memory 302 may be executed by one or more processors, such as a processor 308. The processor 308 may be operative on the data 306.

The processor 308, as shown, is coupled to one or more input/output (I/O) devices 310. In some embodiments, the I/O device(s) 310 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 310, in some embodiments, include communication components, such as broadband or wireless communication elements. The I/O device(s) 310 can be remote from the other components of the computing system 300, such as through a remote access terminal or internet connected devices.

The components of the computing system 300 may be operably and/or communicably connected by one or more buses. The computing system 300 may further include other features or components as known in the art. For example, the computing system 300 may include one or more transceivers and/or devices configured to transmit and/or receive information or data from sources external to the computing system 300 (e.g., part of the I/O devices 310) and/or with motion state sensors associated with health monitoring, as described herein (e.g., machine motion state sensor 113 and on-car motion state sensor 228, described above). For example, in some embodiments, the computing system 300 may be configured to receive information over a network (wired or wireless) or through a cable or wireless connection with one or more devices remote from the computing system 300 (e.g. direct connection to an elevator machine and/or wireless connection to on-car components, etc.). The information received over the communication network can be stored in the memory 302 (e.g., as data 306) and/or may be processed and/or employed by one or more programs or applications (e.g., program 304) and/or the processor 308.

The computing system 300 is one example of a computing system that can be used to execute and/or perform embodiments and/or processes described herein. For example, the computing system 300, when configured as part of an elevator control system, is used to receive commands and/or instructions and is configured to control operation of an elevator car through control of an elevator machine. The computing system 300 can be integrated into or separate from (but in communication therewith) an elevator controller and/or elevator machine and operate as a portion of a dynamic compensation control system and/or health monitoring system. As used herein, the term "dynamic compensation control system" refers to one or more components configured to control movement and, particularly, a dynamic compensation control mode of an elevator car.

The computing system 300 is configured to operate and/or perform a health monitoring operation with respect to an elevator dynamic compensation control system. As noted above, a dynamic compensation control mode of operation is used to mitigate or significantly reduce elevator car bounce. Such elevator car bounce may be a result of long load bearing members (e.g., belts, ropes, cables, or other suspension mechanism) used to suspend and move the elevator car within an elevator shaft and/or as a result of changes in elevator car load (e.g., changes in weight pulling on the load bearing members). For example, in high-rise buildings, due to the length of the load bearing members, a suspended elevator car may bounce or move slightly when at a landing. Such effects may be observed in high rise elevator systems (e.g., systems within tall buildings) when the elevator car is at a relatively low landing (e.g., close to the ground floor of the building). In such instances, the load bearing members can be sufficiently extended and long that extension (e.g., stretching) or contraction of the load bearing members may occur. Such extension or contraction can cause the elevator car to move relative to a stopped position, even if brakes are engaged to prevent movement of the machine. That is, the movement of the elevator car can be independent of the operation of the machine that drives movement of the elevator car within the elevator shaft.

For example, an elevator system typically includes a plurality of load bearing members that are driven by an elevator machine to move an elevator car vertically within an elevator between a number of elevator landings or floors (see, e.g., FIG. 1). When the elevator car is stopped at a respective one of the elevator landings, changes in magnitude of a load within the car (e.g., changes in weight) can cause changes in vertical position of the car relative to the landing, which can include velocity and/or acceleration, i.e., motion states. As discussed above, the term "motion state" includes, but is not limited to, position, velocity, and acceleration. That is, the motion state of the elevator car can be the absolute position of the car within an elevator shaft, the first derivation or change in position of the car (e.g., velocity), or the second derivative or change in velocity of the car (e.g., acceleration). Accordingly, motion state is not limited to merely motion, but also includes a static or absolute position of the elevator car and movement of the car within the elevator shaft.

In operation, the elevator car will move vertically down relative to the elevator landing when one or more passengers and/or cargo move from the landing into the elevator car (e.g., positive load change). The elevator car will move vertically up relative to the elevator landing when one or more passengers and/or cargo move from the elevator car onto the landing (e.g., negative load change). The term "load change" as used herein includes persons, objects, cargo, things, etc. that may be loaded onto (e.g., enter) or unloaded from (e.g., exit) an elevator car. A positive load change is an increase in weight that is suspended by the load bearing members and a negative load change is a decrease in weight that is suspended by the load bearing members.

Such changes in the vertical position of the elevator car and/or other changes in the motion state of the elevator car can be caused by soft hitch springs or isolation pads, stretching and/or contracting of the load bearing members, and/or for various other reasons, particularly where the elevator system has a relatively large travel height and/or a relatively small number of load bearing members. Under certain conditions, the stretching and/or contracting of the load bearing members and/or hitch springs can create disruptive oscillations, position deflections, or vibrations in the motion state of the elevator car, e.g., an up and down motion of the elevator car. In accordance with embodiments of the present disclosure, systems and processes for monitoring dynamic compensation control systems are provided (e.g., "health monitoring" systems and processes).

Figure 4:
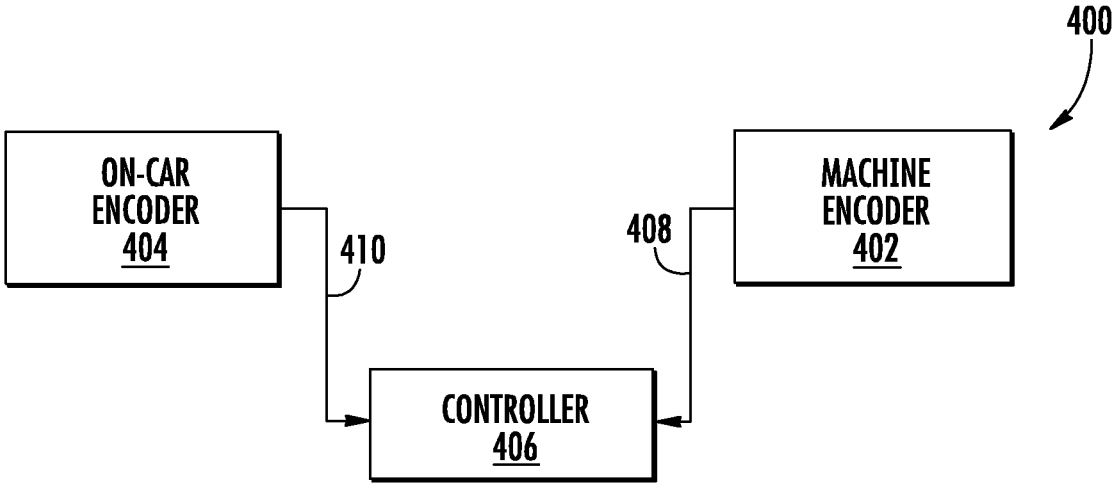
FIG. 4 is a schematic block diagram illustrating a health monitoring system in accordance with an embodiment of the present disclosure.

Turning now to FIG. 4, a schematic block diagram of a health monitoring system 400 in accordance with an embodiment of the present disclosure is shown. The health monitoring system 400 includes a machine motion state sensor 402, an on-car motion state sensor 404, and a controller 406. The machine motion state sensor 402 may be similar to that described above with respect to FIGS. 1A-1B or may be any elevator machine-based positioning and/or motion state system, device, or component, as will be appreciated by those of skill in the art. The on-car motion state sensor 404 may be similar to that shown and described above with respect to FIGS. 2A-2B or may be any on-car positioning and/or on-car motion state system, device, or component, as will be appreciated by those of skill in the art. The controller 406 may be a computing system, such as that described with respect to FIG. 3 and may be integrated into or part of an elevator controller or other electronics of an elevator system, or may be a discrete/separate health monitoring computing device.

As shown, each of the machine motion state sensor 402 and the on-car motion state sensor 404 are in communication with the controller 406. The machine motion state sensor 402 can output a first motion state sensor signal 408 to the controller 406 and the on-car motion state sensor 404 can output a second motion state sensor signal 410 to the controller 406. The controller 406 will monitor both of the motion state sensor signals 408, 410 and make a comparison of the motion state sensor signals 408, 410 to monitor a health status of the on-car motion state sensor 404. The controller 406 is configured to monitor and compare the first and second motion state sensor signals 408, 410 to ensure that the two signals remain within a predefined tolerance, in order to monitor a health state of the on-car motion state sensor 404 and an associated dynamic compensation control system that employs the on-car motion state sensor 404. If the controller 406 detects operation of the on-car motion state sensor 404 outside of the predefined tolerance (e.g., the second motion state sensor signal 410 does not match the first motion state sensor signal 408 within the tolerance), the controller 406 can shut down or disable dynamic compensation control mode of operation of an elevator system. In such instances, when the dynamic compensation control system is disabled, traditional landing leveling control can be performed using the elevator machine and the machine motion state sensor 402.

Figure 5A:
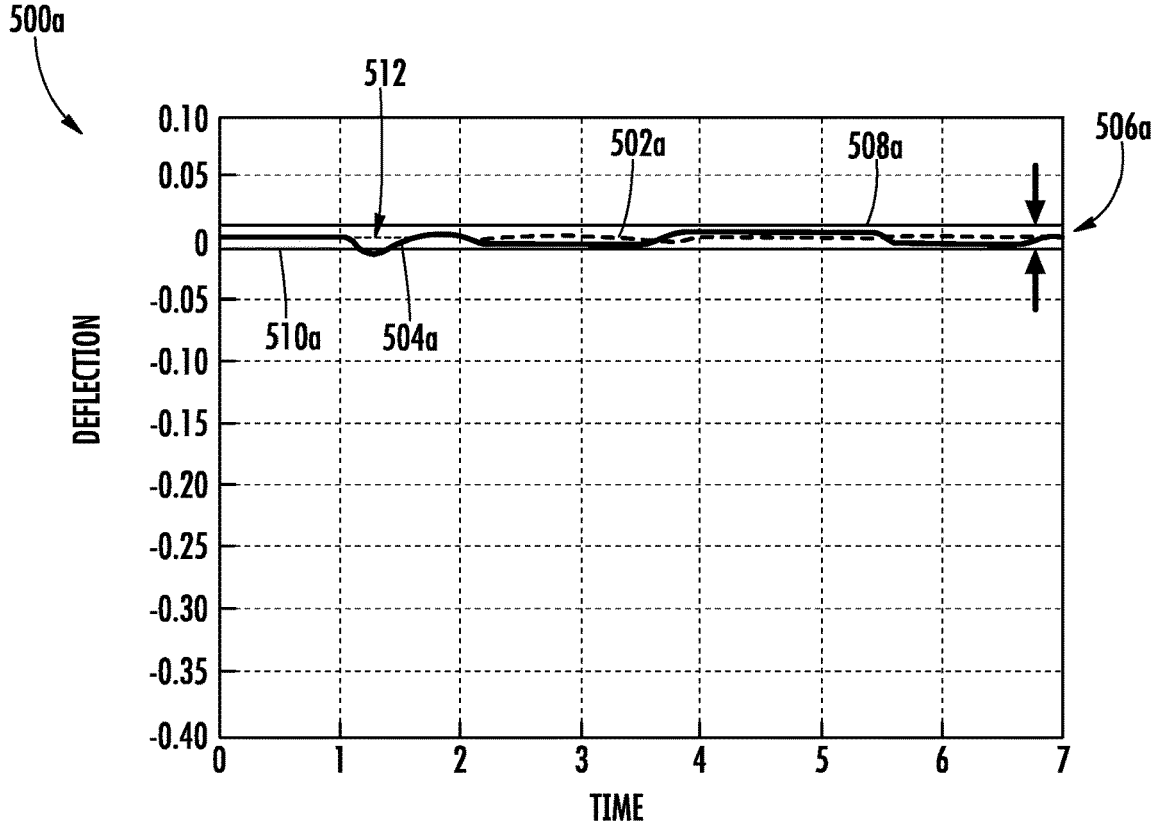
FIG. 5A is a schematic plot of an elevator system operating in a normal condition, showing first and second motion state sensor signals.
Figure 5B:
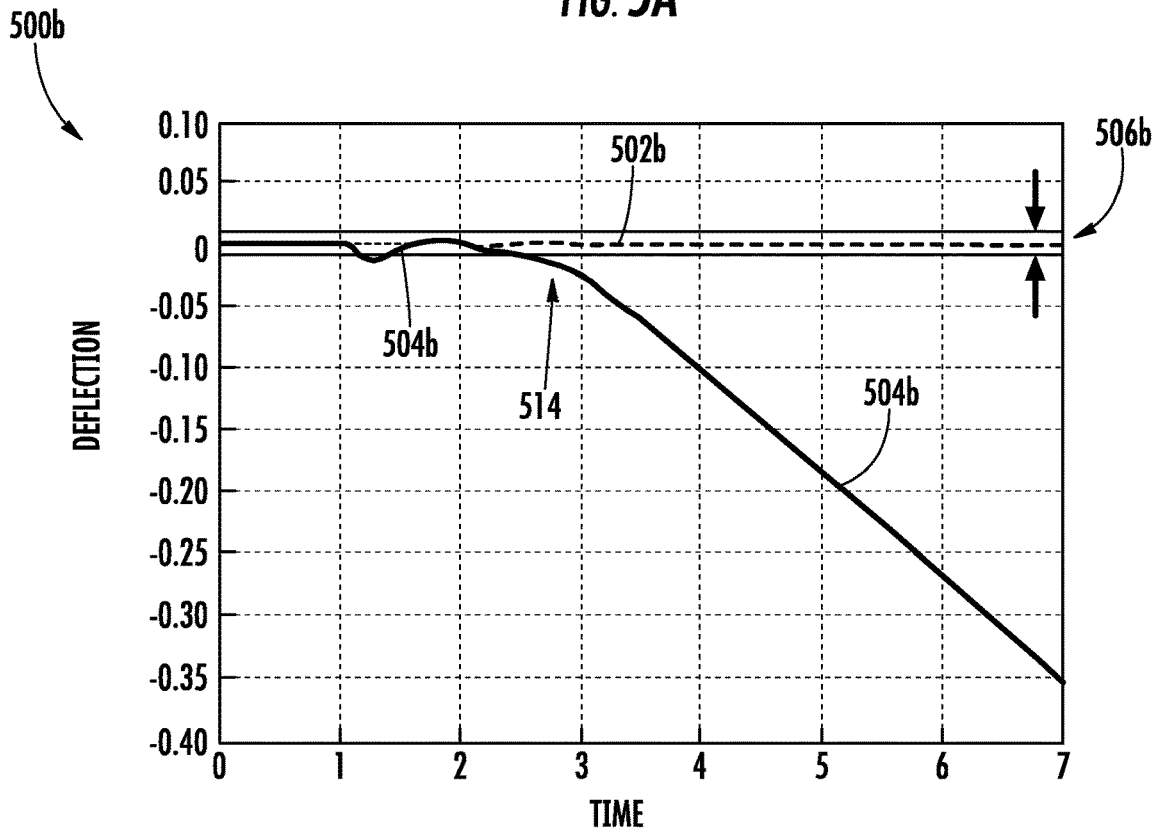
FIG. 5B is a schematic plot of an elevator system with a second motion state sensor operating in a failure state.

Turning now to FIGS. 5A-5B, schematic plots 500*a*, 500*b* showing respective motion state sensor signals 502*a*, 502*b* and car leveling curves 504*a*, 504*b*. FIGS. 5A-5B are illustrative of a system having a single motion state sensor used for car leveling. The motion state sensor signals 502*a*, 502*b*, in both FIGS. 5A-5B, are plots of position versus time as output from a machine motion state sensor or other motion state monitoring device. The car leveling curves 504*a*, 504*b* are plots of position versus time of actual car position or motion. In plots 500*a*, 500*b*, the time and deflection axis are in arbitrary units, but may be for example, in seconds and meters, although other measurements of time and distance (deflection) can be employed without departing from the scope of the present disclosure.

In FIGS. 5A-5B, the zero line of deflection represents a landing position of an elevator car where a floor of the elevator car is level with a floor of a landing such that a transition in the floor surface is substantially continuous and/or flat. If the floor of the elevator car is positioned away from the floor of the landing, a tripping hazard may exist, and thus such deflections are to be avoided.

FIG. 5A illustrates a functioning sensor and leveling operation of the elevator car, with both the motion state sensor signal 502*a* and the car leveling curve 504*a* being maintained at about the zero point (i.e., substantially level floor of car and landing). That is, plot 500*a* illustrates a normally functioning elevator system with an elevator car positioned at a landing being leveled based on the motion state sensor signal 502*a*. As shown, the curves 502*a*, 504*a* are substantially similar to each other with respect to deflection as a function of time. Such similarity is illustrated by the two curves 502*a*, 504*a* remaining within a tolerance 506*a* that has an upper boundary 508*a* and a lower boundary 510*a*. Although schematically shown as the upper and lower boundaries 508*a*, 510*a* of the tolerance 506*a* being substantially equal with respect to a zero deflection (e.g., positive upper boundary 508*a* of tolerance 506*a* is equal and opposite to negative lower boundary 510*a* of tolerance 506*a*), in some embodiments, the upper and lower boundaries of the tolerance may not be equal such that a larger positive or negative deflection may be allowed within the tolerance of the system.

In this system, a single motion state sensor generates the motion state sensor signal 502*a* and thus monitors a motion state of the elevator car, and thus can provide feedback signals to enable car leveling and maintain a level car relative to a landing. Shown in FIG. 5A, an out-of-tolerance section 512 of the motion state sensor signal 502*a* and car leveling curve 504*a* is shown extending outside of the tolerance 506*a*. Such out-of-tolerance section 512 may be confined within a timing threshold such that if the out-of-tolerance section 512 exists for a predefined period of time or a time less than such redefined period of time, no error may present in the system (e.g., due to adjusting weight within the elevator car). However, if the out-of-tolerance section 512 exists for longer than the predefined period of time, it can be determined that an error in the system exists. Alternatively, if the deflection within the out-of-tolerance section 512 is greater than some percentage or multiplier of the tolerance deflection (or some ratio of the tolerance deflection), an error can be determined.

Turning now to FIG. 5B, the plot 500*b* illustrates a malfunctioning of an operation of a motion state sensor, and indicates out-of-normal operation is being performed. In this illustration, a motion state sensor signal 502*b* represents a motion state sensor signal of a machine motion state sensor, as described above. Throughout the observational period represented by the plot 500*b*, the motion state sensor signal 502*b* remains within a tolerance 506*b* (similar to that described above). However, as shown, the car leveling curve 504*b* indicates a deviation 514 outside of a tolerance 506*b*. At the deviation 514 the car leveling curve 504*b* indicates that the car has moved away from the landing. However, because the motion state sensor malfunctioned, the motion state sensor signal 502*b* is shown within the tolerance 506*b* and no indication of a malfunction is provided.

It is desirable to minimize and/or prevent occurrences such as shown in FIG. 5B. Accordingly, embodiments provided herein are directed to improved motion state and/or position sensing and leveling systems to ensure that an elevator car will not deviate, even when a single sensor fails.

Figure 6:
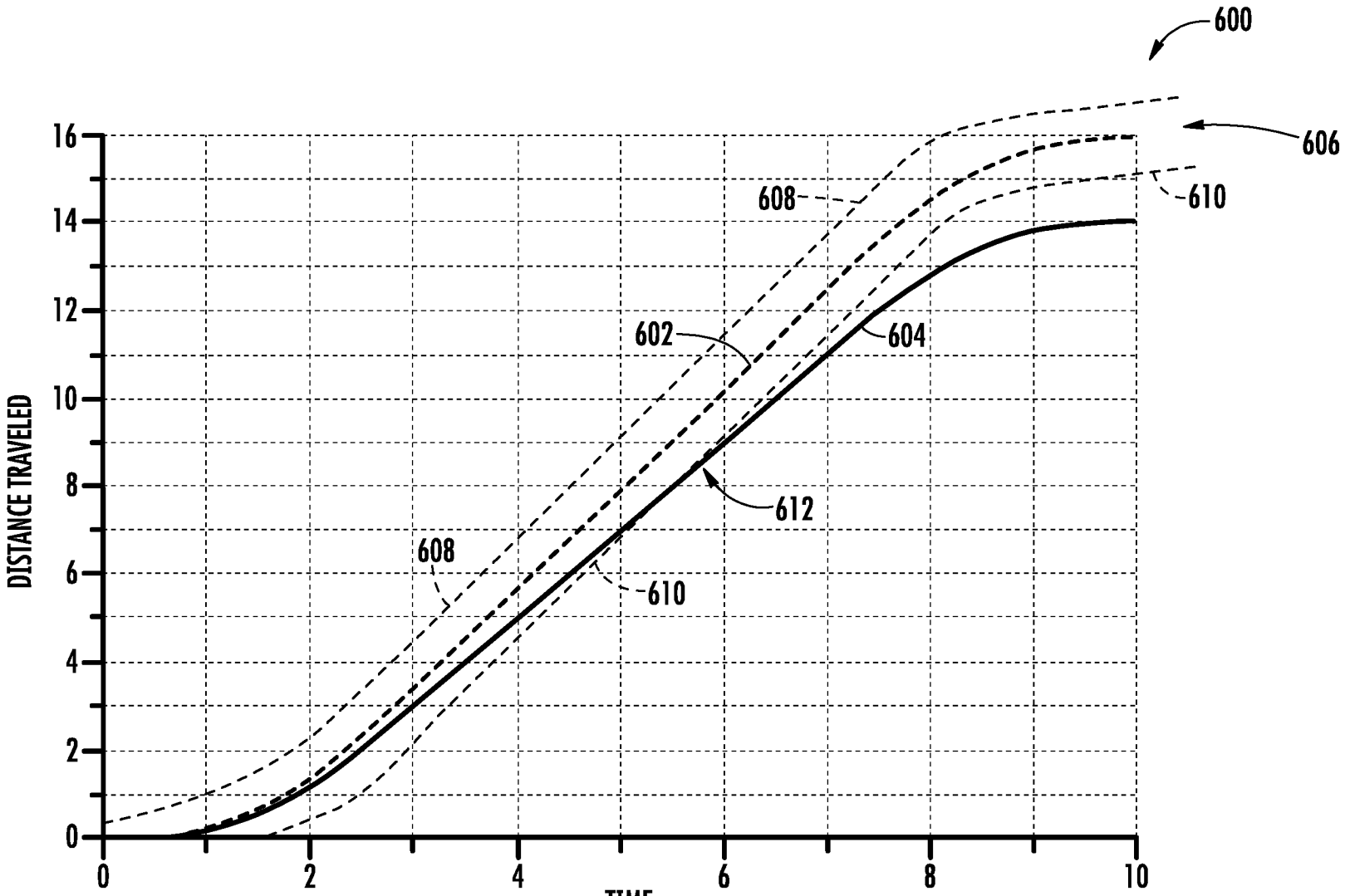
FIG. 6 is a schematic illustration of a plot to demonstrate a health monitoring process in accordance with an embodiment of the present disclosure.

Turning now to FIG. 6, a schematic plot 600 representative of a health monitoring process in accordance with an embodiment of the present disclosure is shown. Plot 600 has time on the horizontal axis and distance traveled on the vertical axis. Plotted on plot 600 is a first motion state sensor signal 602 as generated by a first motion state sensor of a dynamic compensation control system, such as a machine motion state sensor. A second motion state sensor signal 604 is also shown and is generated by a second motion state sensor of the dynamic compensation control system, such as an on-car motion state sensor. In this example, illustrative embodiment, a tolerance 606 is continuously monitored by a computing system. The tolerance 606 is a range of distance values that are calculated based on a machine motion state sensor signal. As shown, the tolerance 606 includes an upper boundary 608 and a lower boundary 610. FIG. 6 illustrates a tolerance 606 that is a fixed or absolute limit (e.g., plus and minus), as an illustrative example. Other tolerance limits, such as relative limits, could also be employed, as will be appreciated by those of skill in the art.

As an elevator car travels from one landing to another (e.g., dynamic compensations/leveling is not being performed) the health monitoring system will check a measurement of distance traveled that is recorded by the second motion state sensor (e.g., second motion state sensor signal 604) against a measurement of distance traveled that is recorded by the first motion state sensor (e.g., first motion state sensor signal 602). The health monitoring system will determined if the second motion state sensor signal is within the tolerance 606. If the second motion state sensor signal 604 exceeds either the upper or lower boundaries 608, 610 and thus exceeds the tolerance 606, the health monitoring system may control a dynamic compensation control system to not perform a dynamic compensation control operation at the next landing (i.e., the dynamic compensation control system can be deactivated). The health monitoring system can also instruct an elevator machine or controller to perform traditional re-leveling operations at landings until the second motion state sensor signal 604 is measured within the tolerance 606. As shown, in FIG. 6, the second motion state sensor signal 604 is shown deviating outside of the tolerance 606 at point 612. Although shown in FIG. 6 with the upper boundary 608 and the lower boundary 610 appearing equidistance from the first motion state sensor signal 602, in various other embodiments the upper and lower boundaries may have different separations from the first motion state sensor signal 602.

Figure 7:
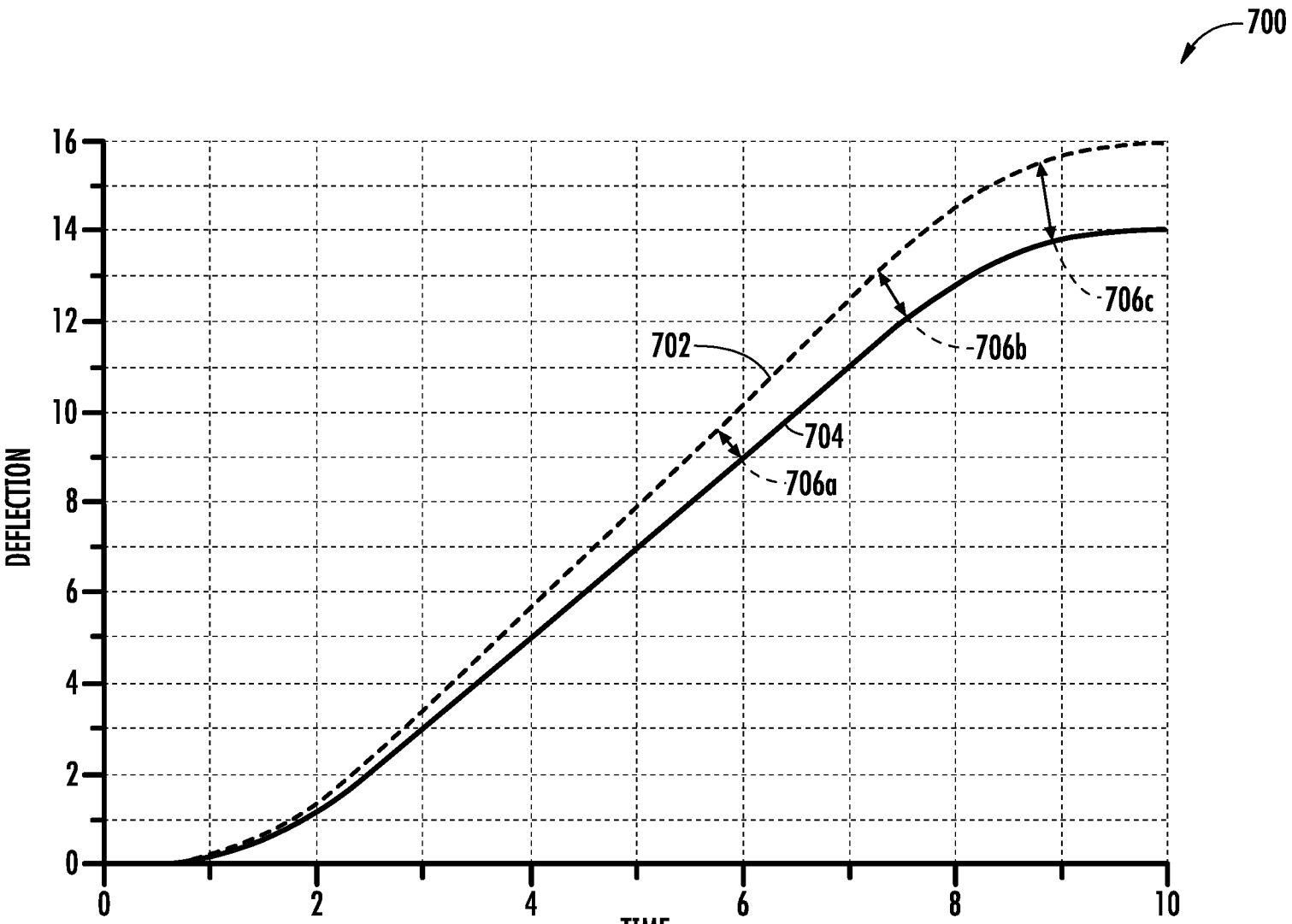
FIG. 7 is a schematic illustration of a plot to demonstrate another health monitoring process in accordance with an embodiment of the present disclosure.

Turning now to FIG. 7, a schematic plot 700 representative of a health monitoring process in accordance with an embodiment of the present disclosure is shown. Plot 700 has time on the horizontal axis and distance traveled on the vertical axis. Plotted on plot 700 is a first motion state sensor signal 702 as generated by a first motion state sensor of a dynamic compensation control system, such as a machine motion state sensor. A second motion state sensor signal 704 is also shown and is generated by a second motion state sensor of the dynamic compensation control system, such as an on-car motion state sensor. In this example, illustrative embodiment, a tolerance is continuously monitored by a computing system by measuring a distance or separation between the first motion state sensor signal 702 and the second motion state sensor signal 704.

As an elevator car travels from one landing to another (e.g., dynamic compensations/leveling is not being performed) the health monitoring system will check a distance traveled as recorded by the first and second motion state sensors and compare the first and second motion state sensor signals 702, 704. The health monitoring system will compare the two values (e.g., take an absolute value of the difference between the two motion state sensor signals) and determine if the determined difference is within a predefined tolerance value. In plot 700, the difference between the motion state sensor signals 702, 704 is indicated at 706*a*, 706*b*, 706*c* which are difference measurements taken at different times. If the difference 706*a*, 706*b*, 706*c* exceeds the predetermined tolerance, the health monitoring system may control a dynamic compensation control system to not perform a dynamic compensation control operation at the next landing (i.e., the dynamic compensation control system can be deactivated). The health monitoring system can also instruct an elevator machine or controller to perform traditional re-leveling operations at landings until a difference between motion state sensor signals is within the tolerance.

Figure 8:
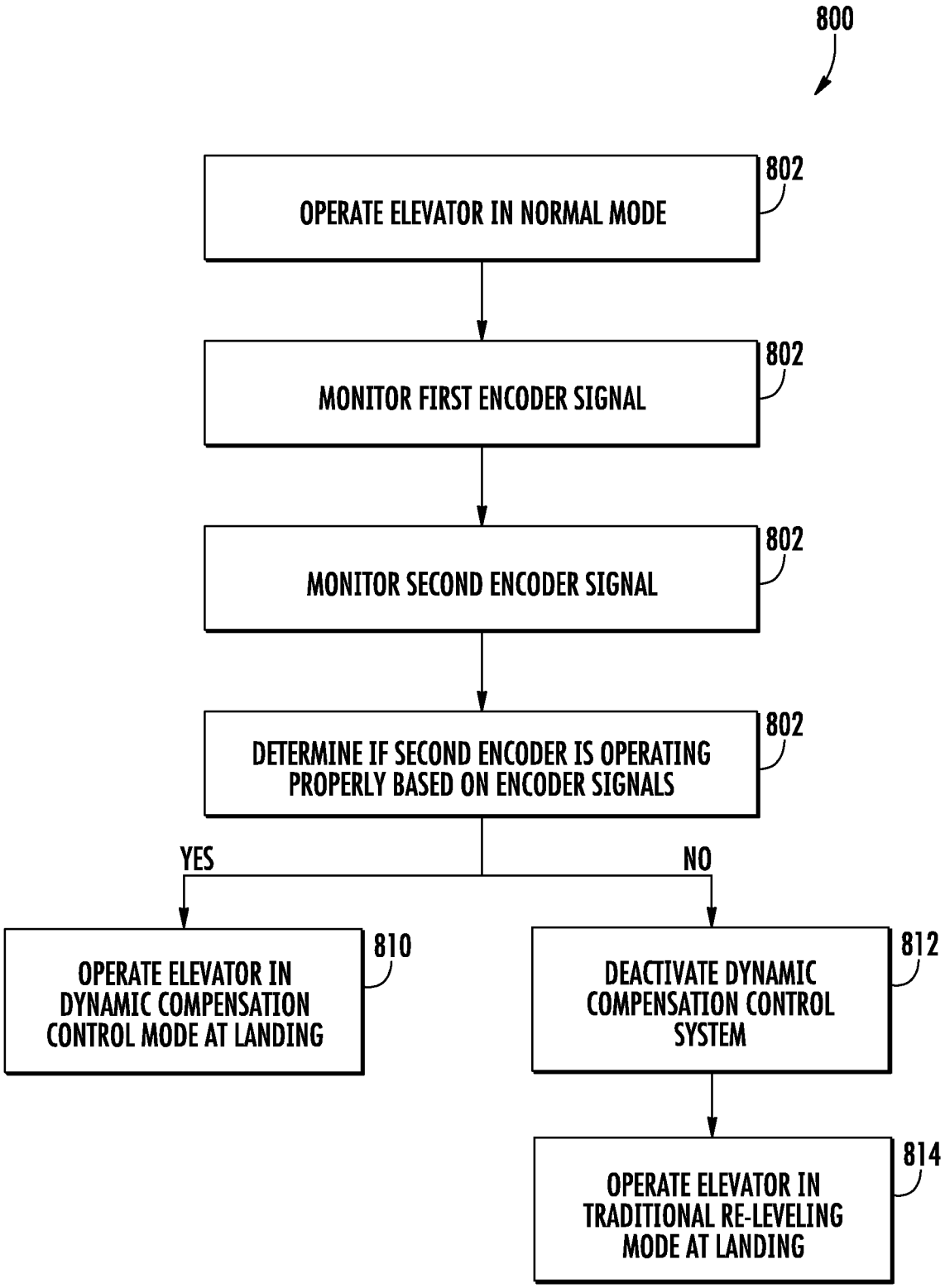
FIG. 8 is a flow process for controlling an elevator system in accordance with an embodiment of the present disclosure.

Turning now to FIG. 8, a flow process 800 for operating an elevator system in accordance with an embodiment of the present disclosure is shown. The flow process 800 can be performed as part of a routine or maintenance schedule to monitor operating and/or mechanical conditions of an elevator system. For example, the flow process 800 may be a process for monitoring a dynamic compensation control system of an elevator system.

The elevator system includes an elevator car moveable within an elevator shaft between landings or floors. The elevator system further includes a first motion state sensor, such as an elevator machine motion state sensor, and a second motion state sensor that is located on the elevator car (e.g., associated with elevator car guiding devices such as roller guides). The first and second motion state sensors are arranged to provide motion state sensor signals to a position control system and/or dynamic compensation control system to perform dynamic compensation control operations when the elevator car is located at a landing. A health monitoring system is also in communication with the first and second motion state sensors to receive the motion state sensor signals therefrom. In some embodiments, the health monitoring system and the dynamic compensation control system are a single unit and further may be process routines (e.g., programs) that are performed using an elevator controller.

At block 802, the elevator car is moved in a normal mode of operation, such as between elevator floors. In such operation, the position of the elevator car (e.g., movement) is driven by an elevator machine as the elevator car is moved within an elevator shaft along guide rails (e.g., as shown in FIGS. 1A-1B). As the elevator car moves along the guide rails, a first motion state sensor monitors the movement of the elevator car by monitoring a drive characteristic of an elevator machine (e.g., rotations) and a distance of travel can be calculated. Similarly, the second motion state sensor that is on the elevator car can monitor a distance of travel by monitoring revolutions, rotations, or other characteristics of the elevator car itself (or a component thereof, such as a roller guide).

At block 804, the health monitoring system will monitor a first motion state sensor signal, as generated by the first motion state sensor.

At block 806, the health monitoring system will monitor a second motion state sensor signal, as generated by the second motion state sensor. Those of skill in the art will appreciate that blocks 804-806 can be performed simultaneously such that the two motion state sensor signals are monitored simultaneously.

At block 808, a determination is made by the health monitoring system regarding a state of operation of the second motion state sensor based on the monitored first and second motion state sensor signals. The determination may be an analysis of the first and second motion state sensor signals that is performed by a computing system. For example, the health monitoring system can analyze and monitor for deviation of the second motion state sensor signal from (or relative to) the first motion state sensor signals (e.g., as shown in FIG. 7) or can monitor whether the second motion state sensor signal stays within or exceeds a tolerance based on a value of the first motion state sensor signal (e.g., as shown in FIG. 6). The determination made at block 808 is with respect to an operational status of the second motion state sensor. A first operational status may be a working condition (e.g., normal operation) and a second operational status may be a failure condition, wherein failure is determined by a deviation of the second motion state sensor signal relative to the first motion state sensor signal. In some embodiments, the determination can include a comparison of the second motion state sensor signal to the first motion state sensor signal, and if the comparison is within a predetermined tolerance, it is determined that the second motion state sensor is operating properly, and the flow process 800 continues to block 810.

At block 810, when it is determined that the second motion state sensor is operating properly, when the elevator car stops at the next landing during normal operation, the dynamic compensation control mode can be employed. When the dynamic compensation control mode is employed, the first and second motion state sensor signals are used to perform dynamic compensation control (e.g., re-leveling) at the landing.

However, if at block 808 it is determined that the second motion state sensor signal is not within the tolerance, it is determined that the second motion state sensor is not operating properly (e.g., failure status). As such, the flow process will continue to block 812.

At block 812, when a failure status is determined, the health monitoring system will deactivate a dynamic compensation control system. Deactivation may entail merely disabling and/or not running a dynamic compensation control mode of operation. As such, when the elevator car approaches a landing to stop and load/unload passengers, the elevator car will not be subject to dynamic compensation control.

Thus, at block 814, when the elevator car approaches the landing for loading/unloading, the motion state of the elevator car relative to the landing will be maintained using a traditional re-leveling mode of operation (e.g., based on the first motion state sensor signal only).

In some embodiments, the health monitoring system can generate a notification that can be transmitted on-site or off-site to indicate that maintenance is required with respect to the dynamic compensation control system.

In some embodiments, the tolerance can be a variable that changes based on a total distance traveled during normal operation mode. That is, the tolerance can be small for short distances of travel of an elevator car, and can increase as a length of travel increases. Further, in some embodiments, the tolerance can be a fixed value for all distances of travel or may be fixed based on a number of landings travelled (e.g., a first tolerance for traveling three of fewer landings, a second tolerance for travel that is four to seven landings, and a third tolerance for travel that is greater than a distance of seven landings). As will be appreciated by those of skill in the art, the tolerance (e.g., absolute values and how implemented) may be based on a particular elevator system and thus various arrangements and configurations are possible without departing from the scope of the present disclosure.

It is noted that the improper operation of the second motion state sensor may occur for various reasons, electrical and/or mechanical. However, the precise cause of possible failure or at least improper operation is not required to be known or anticipated. Embodiments of the present disclosure are arranged to enable prevention of unexpected dynamic compensation control operations (e.g., re-leveling by too much or too little distance). Various on-car (second) motion state sensor failures may include electrical failures (including, but not limited to, power supply failures, processing failures, connection and/or communication failures, noise on a communication line, etc.) and mechanical failures (including, but not limited to, lack of contact between motion state sensor and roller, lack of contact between roller and guide rail, breakage or damage to a component, partial loss of contact, loss of contact but continued spinning of motion state sensor and/or roller, etc.).

Advantageously, health monitoring systems in accordance with the present disclosure can improve the quality, reliability, and service of dynamic compensation control systems, ensuring proper installation of on-car motion state sensors (e.g., alignment, contact pressure, etc.), and detecting on-car motion state sensor faults and failure modes that could produce large unexpected motions of the elevator car during loading and unloading operational scenarios. If the on-car motion state sensor fails or does not operate properly during dynamic compensation control mode, the dynamic compensation control system may generate a command that results in the elevator car moving away from floor level unexpectedly. Accordingly, embodiments of the present disclosure can disable the dynamic compensation control system in such instances to prevent the unexpected movement of the elevator car.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A method of monitoring a dynamic compensation control system of an elevator system, the method comprising:

receiving a first motion state sensor signal generated by a first motion state sensor during travel of an elevator car from one landing to another landing of a plurality of landings of the elevator system, the first motion state sensor associated with an elevator machine;

receiving a second motion state sensor signal generated by a second motion state sensor during travel of the elevator car from the one landing to the another landing of a plurality of landings of the elevator system, the second motion state sensor located on the elevator car;

performing a dynamic compensation control mode of operation to control a motion state of the elevator car relative to a landing with a computing system by controlling the elevator machine to minimize oscillations, vibrations, excessive position deflections, and/or bounce of the elevator car at the landing;

determining an operational status of the second motion state sensor based on an analysis of the first motion state sensor signal and the second motion state sensor signal, wherein the operational status is determined to be a failure status in response to the second motion state sensor signal being outside of a predetermined tolerance relative to the first motion state sensor signal; and in response to determining that the operational status of the second motion state sensor is the failure status deactivating the dynamic compensation control mode of operation of the elevator system and performing a re-leveling operation with the elevator machine and the first motion state sensor signal at a landing while the dynamic compensation control mode of operation remains deactivated.

2. The method of claim 1, wherein the determination of the operational status of the second motion state sensor is performed during a travel of the elevator car between landings of the elevator system.

3. The method of claim 1, wherein the predetermined tolerance is defined by an upper boundary and a lower boundary relative to the first motion state sensor signal.

4. The method of claim 1, wherein the predetermined tolerance is one of (i) fixed for all distances of travel of the elevator car within an elevator shaft or (ii) variable based on a distance of travel of the elevator car within an elevator shaft.

5. The method of claim 1, wherein the first motion state sensor and the second motion state sensor each measure one of a position, a velocity, an acceleration, or a combination thereof.

6. The method of claim 1, further comprising generating a notification regarding a failure status and transmitting said notification to provide notice that maintenance is required on the second motion state sensor.

7. An elevator control system for controlling an elevator system, the elevator control system comprising:

an elevator machine operably connected to an elevator car located within an elevator shaft;

a first motion state sensor arranged relative to the elevator machine to monitor a motion state of the elevator car within the elevator shaft;

a second motion state sensor arranged on the elevator car and configured to monitor a motion state of the elevator car within the elevator shaft;

a computing system in communication with the first motion state sensor and the second motion state sensor, the computing system receiving a respective first motion state sensor signal and a second motion state sensor signal during travel of the elevator car from one landing to another landing of a plurality of landings of the elevator system, the computing system configured to perform health monitoring of the second motion state sensor, wherein the computing system is configured to perform a dynamic compensation control mode of operation to control a motion state of the elevator car relative to a landing by controlling the elevator machine to minimize oscillations, vibrations, excessive position deflections, and/or bounce of the elevator car at the landing, wherein the health monitoring comprises:

receiving the first and second motion state sensor signals from the first and second motion state sensors, respectively;

determining an operational status of the second motion state sensor based on an analysis of the first motion state sensor signal and the second motion state sensor signal, wherein the operational status is determined to be a failure status in response to the second motion state sensor signal being outside of a predetermined tolerance relative to the first motion state sensor signal; and in response to determining that the operational status of the second motion state sensor is the failure status, the computing system deactivates the dynamic compensation control mode of operation of the elevator system and performs a re-leveling operation with the elevator machine and the first motion state sensor signal at the landing while the dynamic compensation control mode of operation remains deactivated.

8. The elevator control system of claim 7, wherein the determination of the operational status of the second motion state sensor is performed during a travel of the elevator car between landings of the elevator system.

9. The elevator control system of claim 7, wherein the predetermined tolerance is defined by an upper boundary and a lower boundary relative to the first motion state sensor signal.

10. The elevator control system of claim 7, wherein the predetermined tolerance is one of (i) fixed for all distances of travel of the elevator car within the elevator shaft or (ii) variable based on a distance of travel of the elevator car within an elevator shaft.

11. The elevator control system of claim 7, wherein the motion states monitored by the first and second motion states sensors are one of a position, a velocity, an acceleration, or a combination thereof.

12. The elevator control system of claim 7, wherein the computing system is configured to generate a notification regarding a failure status and transmitting said notification to provide notice that maintenance is required on the second motion state sensor.

13. The elevator control system of claim 7, wherein at least one of the first motion state sensor and the second motion state sensor is an encoder.

14. The elevator control system of claim 7, further comprising a roller guide located on an exterior of the elevator car and arranged to guide movement of the elevator car relative to a guide rail, wherein the second motion state sensor is an encoder arranged to monitor the roller guide.

* * * * *